US007938263B2

(12) United States Patent
Vijay

(10) Patent No.: US 7,938,263 B2
(45) Date of Patent: May 10, 2011

(54) PACKAGE FOR WRAPPING AT LEAST ONE ARTICLE OR A PRE-ARRANGED GROUP OF ARTICLES

(76) Inventor: Chauhan Vijay, Mumbai (IN)

( * ) Notice: Subject to any disclaimer, the term of this patent is extended or adjusted under 35 U.S.C. 154(b) by 1716 days.

(21) Appl. No.: 10/948,441

(22) Filed: Sep. 23, 2004

(65) Prior Publication Data

US 2005/0194284 A1 Sep. 8, 2005

(30) Foreign Application Priority Data

Mar. 3, 2004 (IN) ..... 260/MUM/2004

(51) Int. Cl.
*B65D 65/00* (2006.01)

(52) U.S. Cl. ..... 206/497; 206/557; 206/820; 229/87.01

(58) Field of Classification Search ..... 206/497; 229/87.01, 87.05, 92, 92.1, 109–112
See application file for complete search history.

(56) References Cited

U.S. PATENT DOCUMENTS

| | | | | | |
|---|---|---|---|---|---|
| 3,405,861 | A | * | 10/1968 | Bush | 206/497 |
| 3,650,395 | A | * | 3/1972 | Hobbs | 206/497 |
| 4,658,963 | A | * | 4/1987 | Jud | 229/87.05 |
| 5,067,612 | A | * | 11/1991 | Tsuchiya et al. | 206/497 |
| 5,240,111 | A | * | 8/1993 | Yamashita et al. | 206/497 |
| 5,375,718 | A | * | 12/1994 | Honma et al. | 206/497 |
| 5,749,466 | A | * | 5/1998 | Seki | 206/497 |
| 6,026,957 | A | * | 2/2000 | Bauer et al. | 229/87.01 |

* cited by examiner

*Primary Examiner* — Luan K Bui
(74) *Attorney, Agent, or Firm* — Charles A. Muserlian

(57) ABSTRACT

An improved package for wrapping at least one article or a pre arranged group of articles, said package being defined by a formed longitudinal tube body of flexible wrapping sheet material having a length, height and width dimension, the said height and/or width dimension being less than the length dimension but greater than one tenth of the length dimension, a fin seal and two cross seals and no end seals, characterized in that the fin seal is formed along the height or width dimension of the package perpendicular to the length dimension and the cross seals are formed along the length dimension, the cross seals being generally perpendicular to the fin seal, the ends of the package being seal-free.

7 Claims, 14 Drawing Sheets

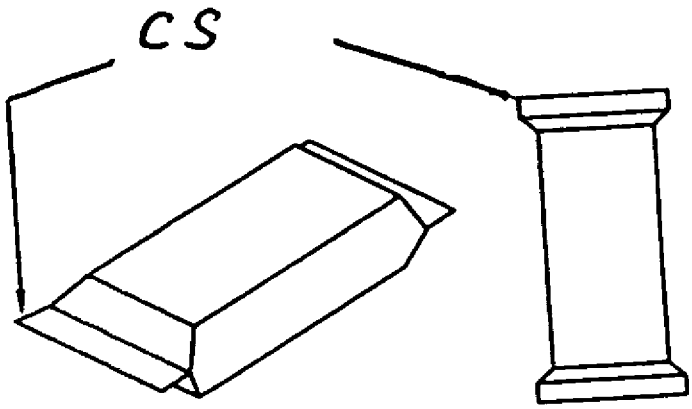
FIG- 21a
FIG- 21 b
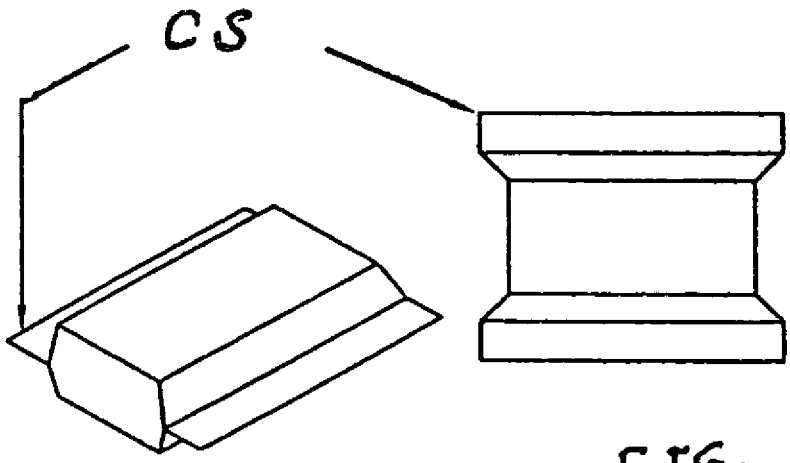
FIG- 22 b
FIG-22a

PACKAGE FOR WRAPPING AT LEAST ONE ARTICLE OR A PRE-ARRANGED GROUP OF ARTICLES

FIELD OF THE INVENTION

This invention relates to packages for wrapping articles or groups of pre-arranged articles.

BACKGROUND OF THE INVENTION

The present invention generally relates to a method of packing, an article or a group of articles pre-arranged to be packed, with a flexible packaging material.

Typically, the flexible packaging material may be a single film or a laminate of one or more materials and having cold or hot sealing properties.

This invention also relates to package for wrapping a article or a group of pre-arranged articles.

Particularly this invention relates to packages of flexible sheet element which are formed in automatic packaging machines with the help of article wrapping devices/apparatus.

The packages in accordance with the prior art are formed in the forming section of horizontal or vertical wrapping machines which are well known in the packaging/material handling art and typically comprise a forming section structure through which an elongated sheet of flexible wrapping material is drawn from a roll. The forming section is operative to continuously form from the sheet a forwardly moving tube having a rearwardly disposed open inlet end, and a laterally projecting "fin" defined by drawn-together side edge portions of the sheet. An article in-feed system is used to insert articles or groups of pre arranged articles to be wrapped into the open tube inlet end. The inserted articles, in a longitudinally spaced group, are then carried within the wrapping material linearly to as it forwardly exits the forming section. The individual articles, or associated groups of articles, as may be the case, forwardly transported within the tube are spaced apart by spaced longitudinal sections of the tube.

As the article-containing tube exits the forming section, the fin portion of the tube is drawn between, and sealed by, an opposed pair of counter rotating sealing elements. The sealed fin is then passed through a foldover station, which operates to fold the sealed fin over onto an adjacent portion of the tube. The tube, with its sealed and folded over fin, is then passed through a cutting and sealing station having cross seal jaws which operates to compress, heat seal, and transversely cut the longitudinal tube sections between longitudinally adjacent articles or groups of pre arranged article pairs, to form individual, article-containing packages with sealed opposite ends.

The speed of the tube section, and subsequent rate of end sealed individual packages produced by the horizontal wrapping machine is dependent upon the rate at which the tube moves linearly through the forming section. Therefore the length of the fin seal is critical to the speed at which the packages are formed end to end.

Further as occasionally happens, particularly when groups of pre arranged articles such as biscuits or cookies arranged as in FIGS. 4B and 4F are packed, displacement of the articles may cause leading or the first article to fall from its vertical position and therefore be trapped between the end seals of two packages, i.e. between the front end seal of one pack and the rear seal of the adjacent pack. This causes wastage of two packs as the trapped article leaves both packs unsealed.

Typical packages produced in accordance with the prior art process have end/cross seals formed on the ends of the packs and are perpendicular to the longer side of the packs and longitudinal fin seal parallel to the longer side of the pack.

One drawback, of the package formed currently in the art is that the end seals distort the ends of the formed package.

Because of the projecting flaps of the end seals these surfaces are not available as display media for the product. In space restricted retail counters often such longitudinal packs are conveniently placed with their ends facing the customer in a stack of competing products. The flaps of the end seals distort the brands or logos provided on the ends of the pack and often the customer has to draw out the pack from the stack to scrutinize the pack.

OBJECTS OF THE INVENTION

One object of this invention, is therefore to eliminate the drawbacks of the prior art packages and provide an improved package, and associated methods, for producing packages with no end seals on individual flexible packages discharged from horizontal wrapping machines, and the like, at an increased rate with a minimum fin seal. It is accordingly an object of the present invention to provide such an improved package and methods of making thereof.

Another object of this invention is to provide a package which can be produced at high speeds, with less wastage of packing material and content and with less manpower per pack.

Still another object of this invention is to provide a pack and a method of forming a pack in which the end faces of the pack are not distorted and are completely available for display.

STATEMENT OF INVENTION

According to this invention there is provided an improved package for wrapping at least one article or a pre arranged group of articles, said package being defined by a formed longitudinal tube body of flexible wrapping sheet material having a length, height and width dimension, the said height and/or width dimension being less than the length dimension but greater than one tenth of the length dimension, a fin seal and two cross seals and no end seals, characterized in that the fin seal is formed along the height or width dimension of the package perpendicular to the length dimension and the cross seals are formed along the length dimension, the cross seals being generally perpendicular to the fin seal, the ends of the package being seal-free.

The articles in the package may be supported in a tray.

The cross seals may be flattened against the body of the package.

Typically, the longitudinal tube body has a generally rectangular cross section. However, the longitudinal tube can alternatively have a circular or oval cross-section or other geometric cross section.

A feature of this invention is that the package formed in accordance with this invention has cross seals which run along the length dimension of the article or pre arranged group of articles as opposed to the conventional pack where the cross seal runs along the width of the article or pre arranged group of articles.

A fin seal runs perpendicular to the length dimension of the article or pre arranged group of articles and therefore along the operative shorter dimension of the package and cross seals, which replace the end seals of the prior art, are provided on the sides of the tube which cross seals are parallel to the longitudinal axis of the package and perpendicular to the fin seal.

The article or pre arranged group of articles are fed within the tube sideways or laterally or width-wise instead of length wise and in the fin sealing station the flexible wrapping sheet is wrapped around the length of the article or the pre arranged group of articles unlike in the conventional feeding system where the articles or pre arranged group of articles are fed along their length and the flexible wrapping sheets are wrapped around the width of the article or group of articles. Therefore both ends of the article or group of articles are unsupported.

The group of packages may be joined to each other along their cross seals and are separated by tearing between the cross seals.

Further since the speed of packaging is dependent upon the length of the fin seal, and since the fin seal is shorter in accordance with the package and method of this invention, the speed of packaging is more than doubled in relation to the speed of packaging of the prior art.

BRIEF DESCRIPTION OF THE DRAWINGS

The invention will now be described with reference to the accompanying drawings, in which FIGS. 1 and 2 explain the general theory of pack design and the dimensions and features referred to in this invention;

FIGS. 21*a* and 21*b* illustrate packages in the prior art which are not gusseted;

FIGS. 22*a* and 22*b* illustrate packages in accordance with this invention which are not gusseted;

DETAILED DESCRIPTION OF THE EMBODIMENTS OF THIS INVENTION

The drawings and description relating thereto are merely illustrative of the features of this invention and do not in any way limit the nature and scope of this invention.

Figure 1:
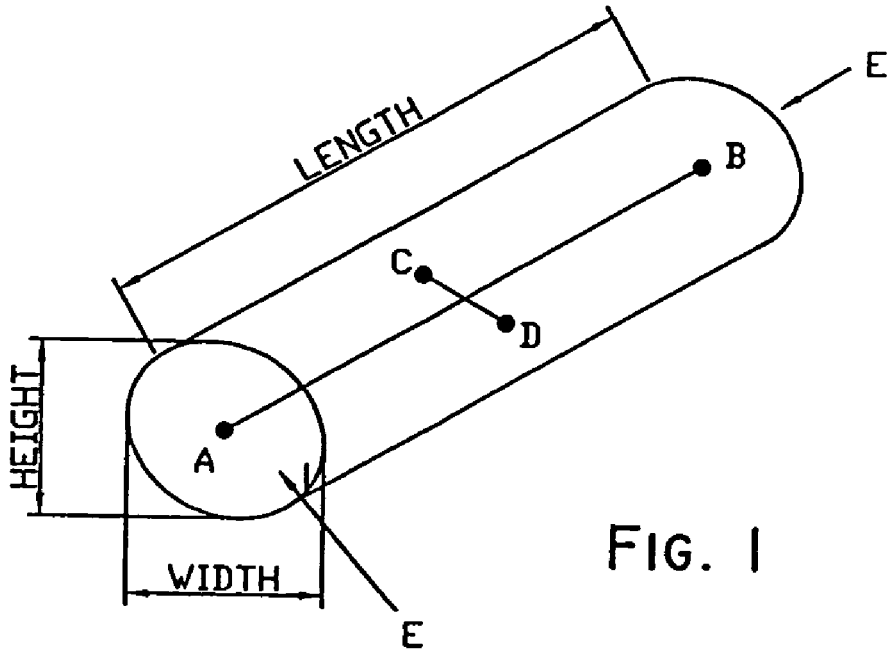
Figure 2:
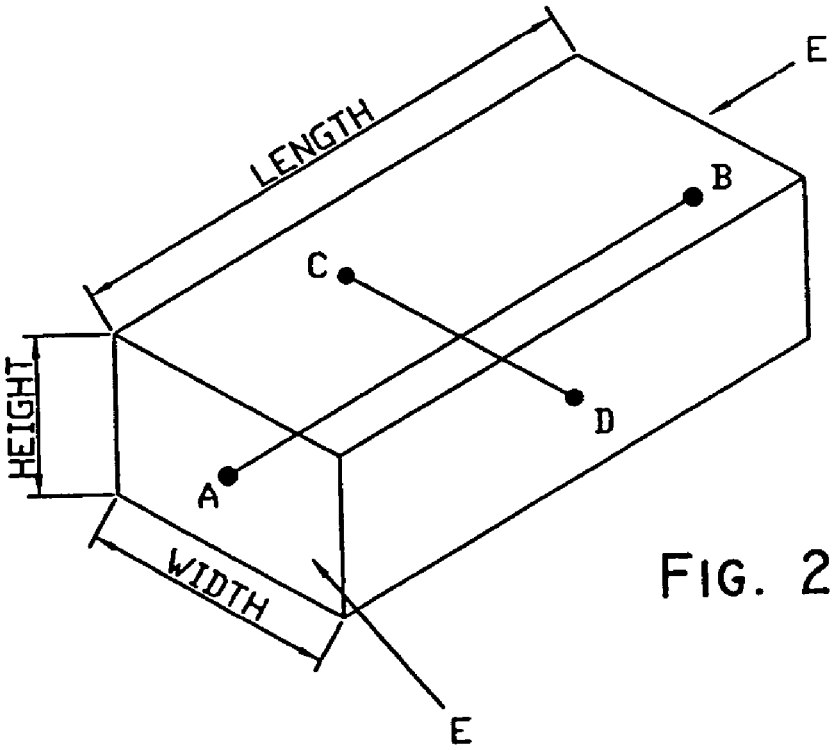
Figure 3A:
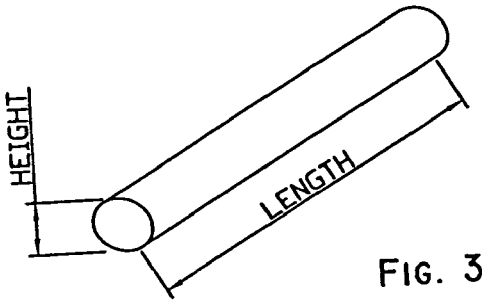
FIGS. 3*a* to 3*e* illustrate slender packages having height less than one tenth of their length.
Figure 3B:
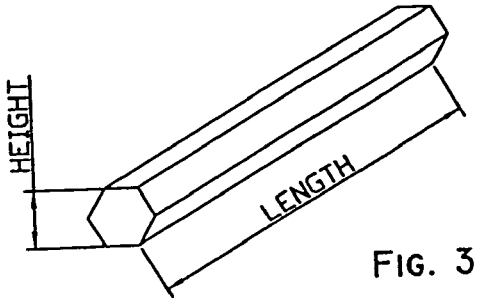
Figure 3C:
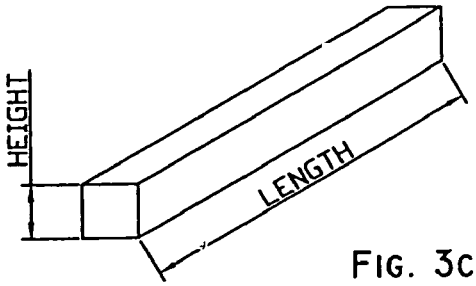
Figure 3D:
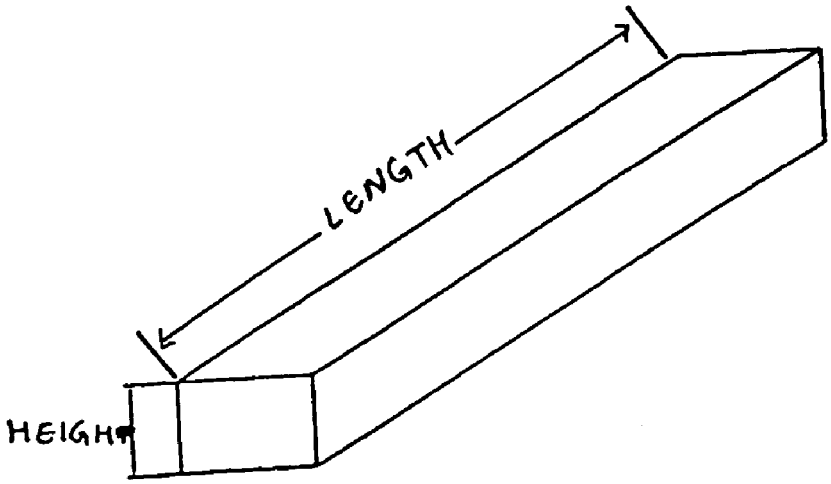
Figure 3E:
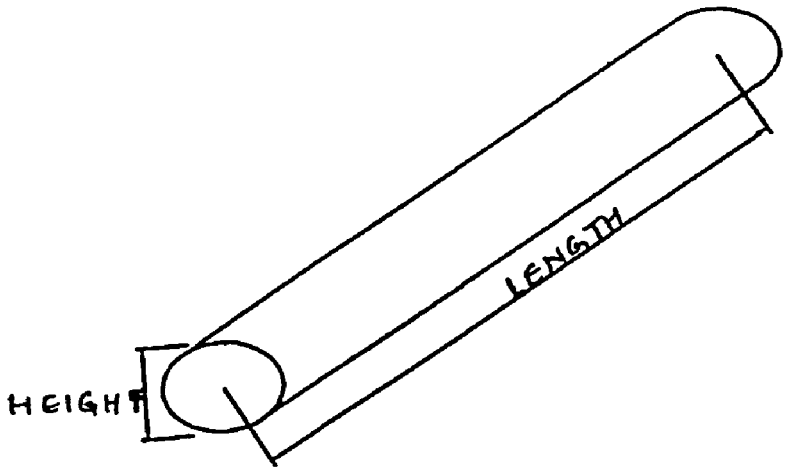

Referring to the drawings, the relative terms length, width and height in respect of packages of this nature for packing articles or pre arranged group of articles to be packed are defined for the purpose of this specification as follows as illustrated in FIGS. 1 and 2 of the accompanying drawings. The use of the expression 'article' includes a single article and where not otherwise stated to include a 'group of pre arranged articles' or a 'pre arranged group of articles'.

In FIGS. 1 and 2 of the accompanying drawings, packages are defined primarily by length dimension 'Length', height dimension 'Height' and width dimension 'width'. Length is the longest dimension of the articles or pre arranged groups of articles, which are required to be packed.

Width is the shorter side of articles or pre arranged groups of articles which are required to be packed; and Height is the relative third dimension besides the width and length.

The height dimension generally lies in a plane perpendicular to the length dimension and is typically operatively shorter than the length dimension.

The term longitudinal axis is the axis defined along the length dimension 'AB' and in the prior art is typically along the direction of travel of the article or the pre arranged group of articles. The ends of the packages, are designated by the reference indication 'E'. The shorter axis parallel to the width dimension of the package is designated 'CD' representing the cross axis.

Figure 4A:
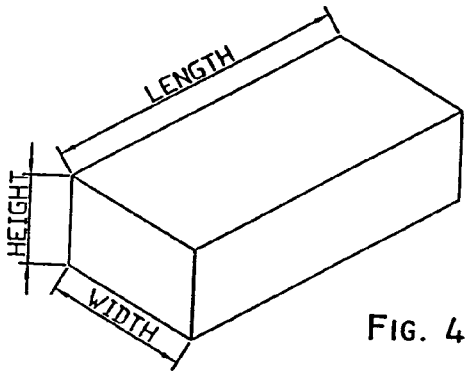
FIGS. 4*a* to 4*g* illustrate some examples of what is meant to mean by an article or a pre arranged group of articles, in accordance with this invention.
Figure 4B:
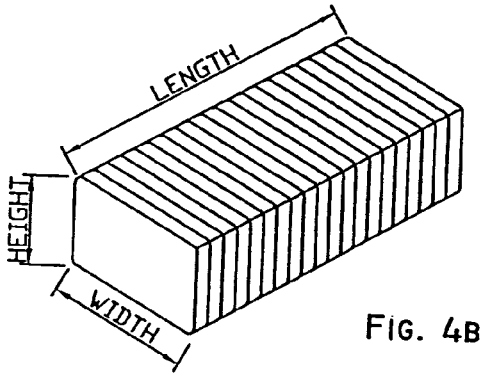
Figure 4C:
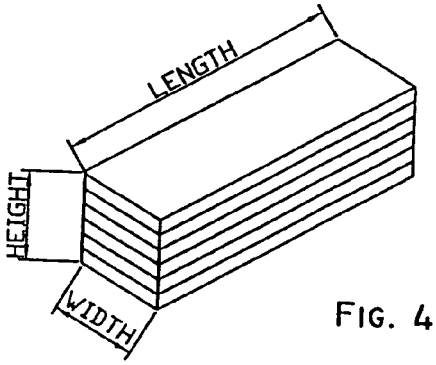
Figure 4D:
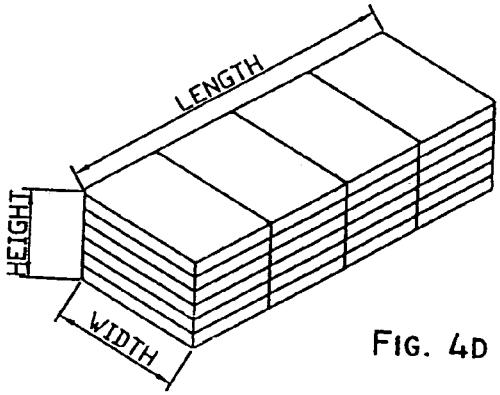
Figure 4E:
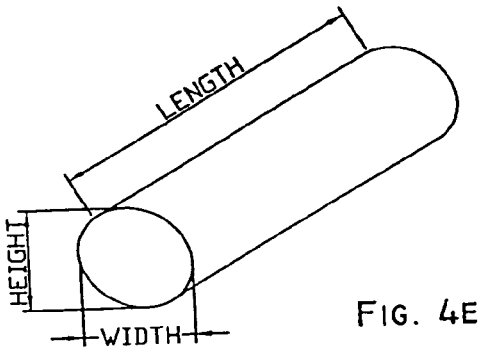
Figure 4F:
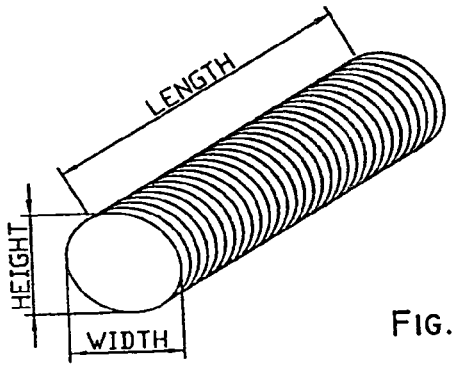
Figure 4G:
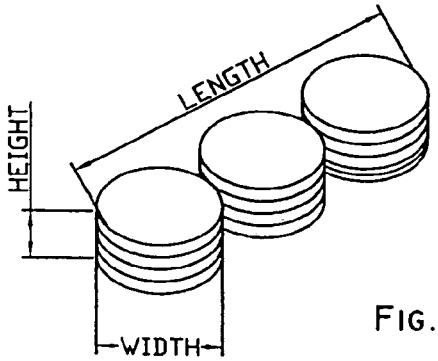

FIGS. 4A to 4G illustrate some examples of what is meant to mean an article or a group of pre arranged articles. It is envisaged that what is not shown but what can be easily understood to one skilled in the art is that the articles and particularly the group of articles may be pre arranged in an orderly manner in a tray although such a tray is not particularly shown or illustrated. For instance, FIG. 4B illustrates rectangular shaped articles standing on edge and arranged in a single group, whereas FIG. 4D shows the same rectangular articles arranged in piles. As can be easily understood both groups of articles are arranged in an orderly manner albeit slightly differently. Similarly, FIGS. 4F and 4G illustrate two different methods of placing circular disc shaped articles either in a linear group or in piles.

This invention is directed to packages where the shorter dimension is more than one tenth of the length. Thus FIGS. 3*a* to 3*e* illustrate slender packages having height less than one tenth of their length which are not within the purview of this invention.

Figure 5:
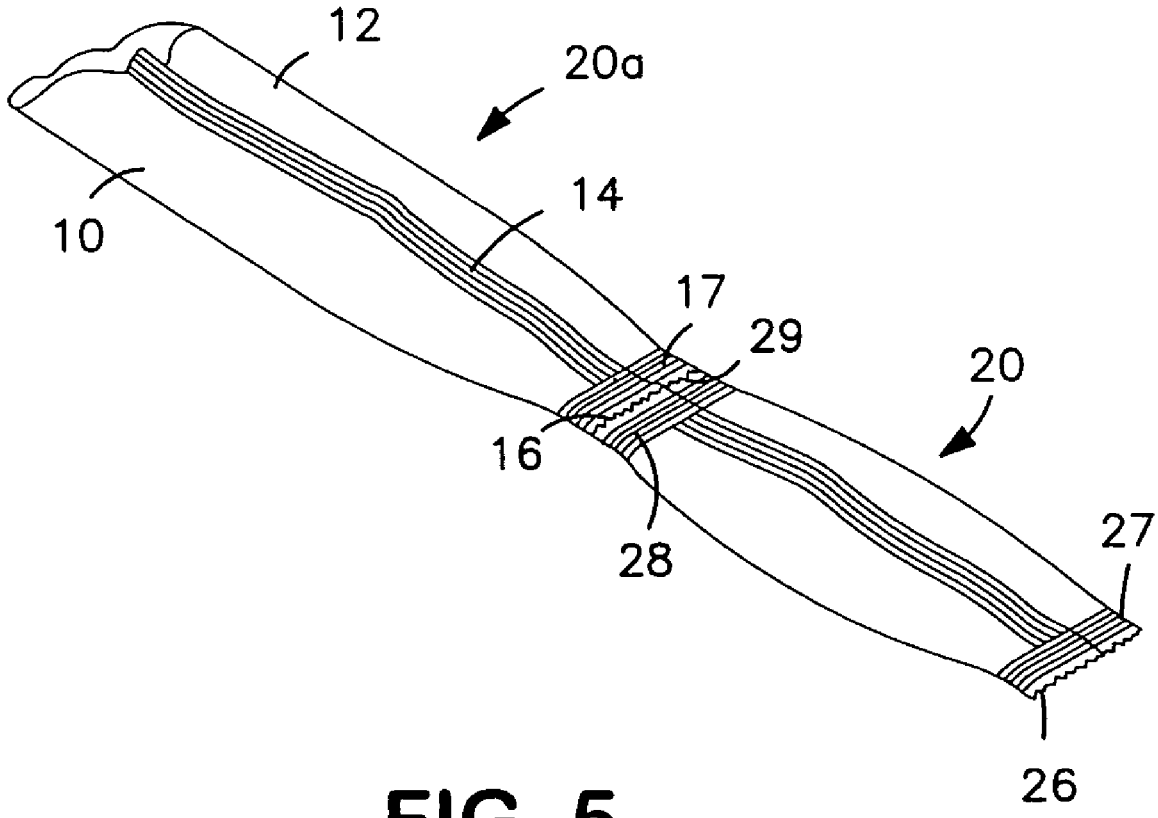
FIG. 5 PRIOR ART
FIGS. 5, 6 and 7 show packages in accordance with the prior art.
Figure 6:
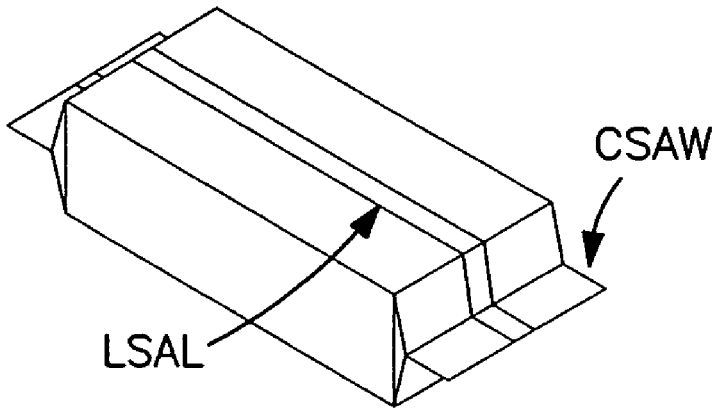
FIG. 6 PRIOR ART
Figure 7:
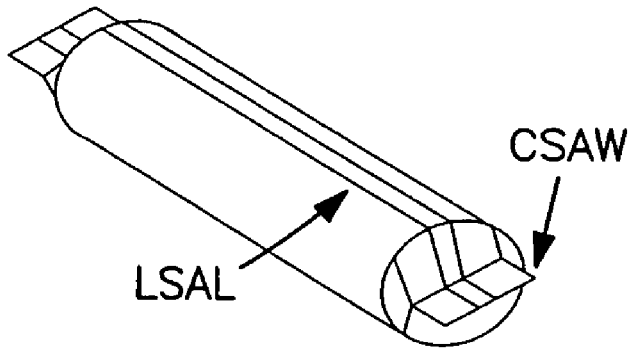
FIG. 7 PRIOR ART
Figure 8:
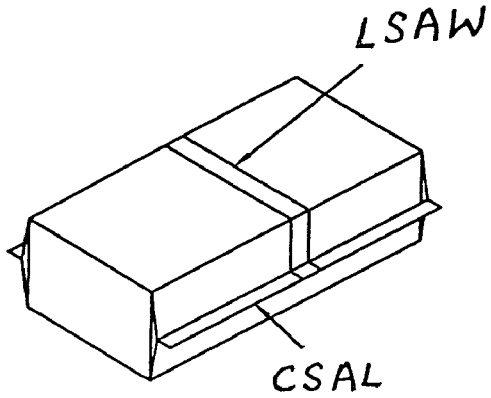
FIGS. 8, 9 10 and 16 show the perspective view of packages of different cross sections in accordance with this invention, having cross seals CSAW and fin seal [LSAW] with the cross seals not flattened against the sides of the package.
Figure 9:
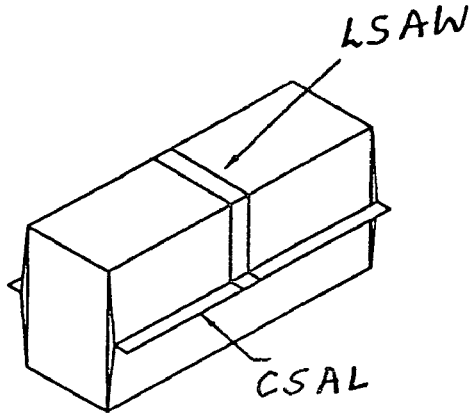
Figure 10:
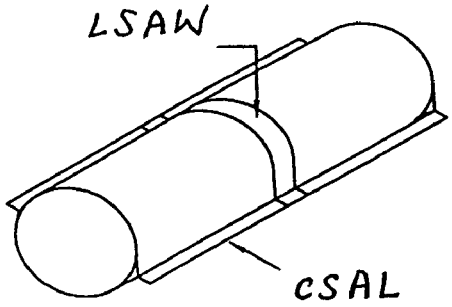
Figure 11:
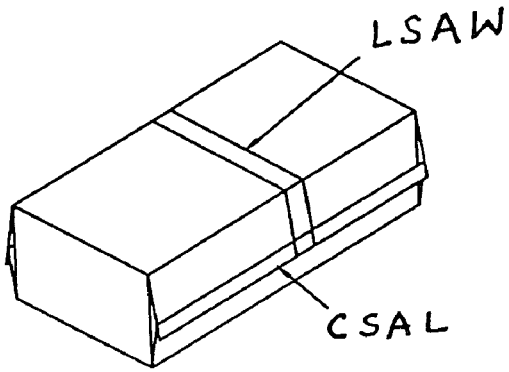
FIGS. 11, 12, and 13 show the perspective view of packages of different cross sections in accordance with this invention, with the cross seals along the length [CSAL] and the fin seal along the width [LSAW] flattened against the sides of the package, FIGS. 14 and 15 although having cross seals [CSAL] are provided to illustrate packages which are relatively flat or pillow shaped and which are not within the purview of this invention; In these cases shown in FIGS. 14 and 15 the packages are such that a shorter dimension [height] is less than one tenth of the length.
Figure 12:
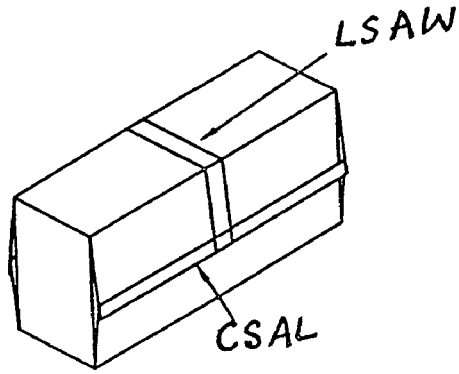
Figure 13:
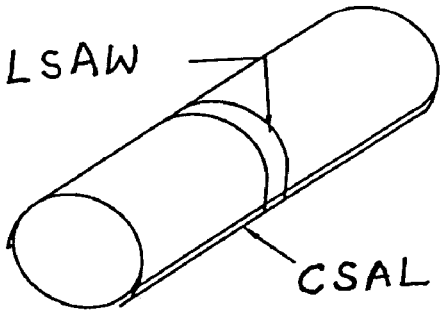
Figure 14:
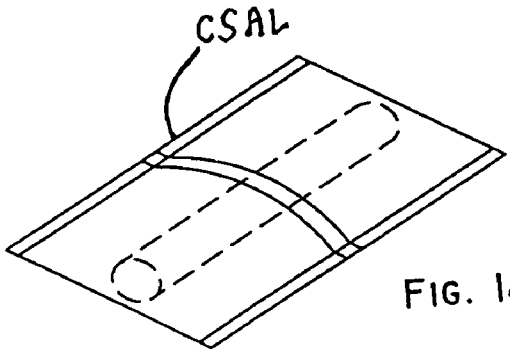
Figure 15:
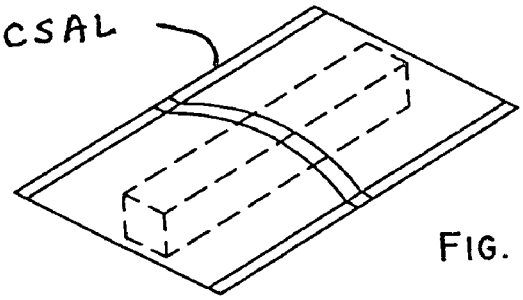
Figure 16:
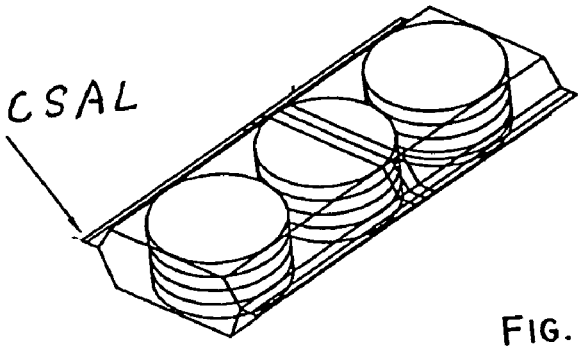

The prior art package is shown in a perspective view in FIGS. 5,6 and 7 of the accompanying drawings in which, there is shown a perspective view illustrating a longitudinal tube 12 made of flexible wrapping material 10, and a flexible package 20 formed from the longitudinal tube 12. The package 20 is formed from a web of sealable sheet material 10 moving along a generally linear approximately horizontal path although in the case of some machines the path can be inclined or vertical. The edges of a cut sheet of the flexible wrapping material 10 are sealed by a fin seal 14 which runs along the direction of travel of the tube 12. A section of the longitudinal tube 12 formed by a first end cut 26, a first end/cross seal 27, a second end/cross seal 28, and a second end cut 29. The second end cut 29 of the flexible package 20 also defines a first end cut 16 in the longitudinal tube 12 for a subsequent flexible package 20*a* to be formed in the longitudinal tube 12. Also, a first end seal 17 is formed in the longitudinal tube 12 in the same process in which the second end seal 28 was formed in the package 20, for forming the subsequent flexible package 20*a* from the longitudinal tube 12.

Depending upon the shape of the article or pre arranged group of articles, the longitudinal package formed may define a typical cross section such as square, rectangular, round or elliptical or oval or other geometrical shapes such as a triangle or pentagon, hexagon, octagon and so on.

Typical packages produced in accordance with the prior art process are shown in FIGS. 6 and 7 which show a prior art rectangular package and a prior art cylindrical package respectively. As seen in FIGS. 6 and 7, end/cross seals 27 and 28 of FIG. 5 are formed on the ends of the packs and are perpendicular to the longer side of the packs whereas longitudinal seal 14 of FIG. 5 is parallel to the longer side of the pack.

Figure 17:
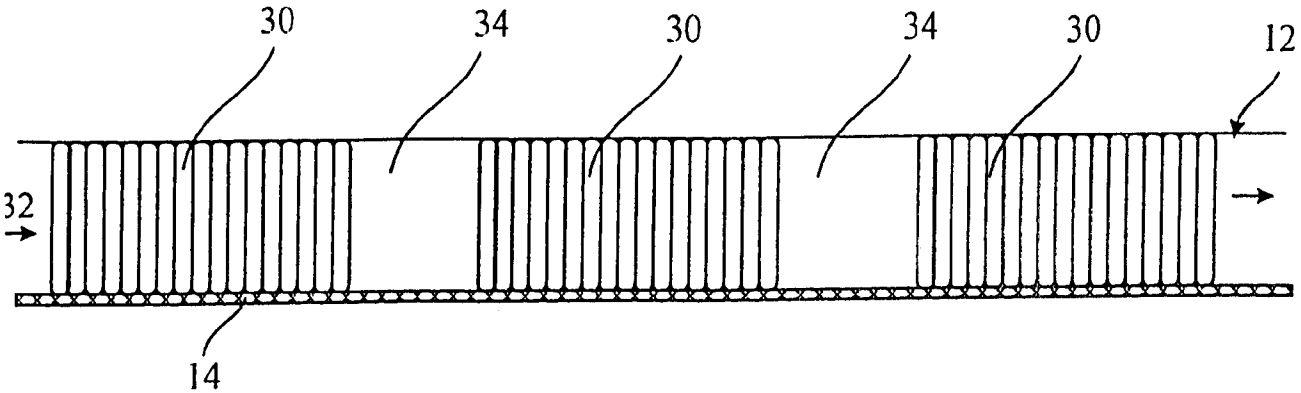
FIG. 17 shows the end elevation of the tube section during the formation of the packages in the prior art.
Figure 18:
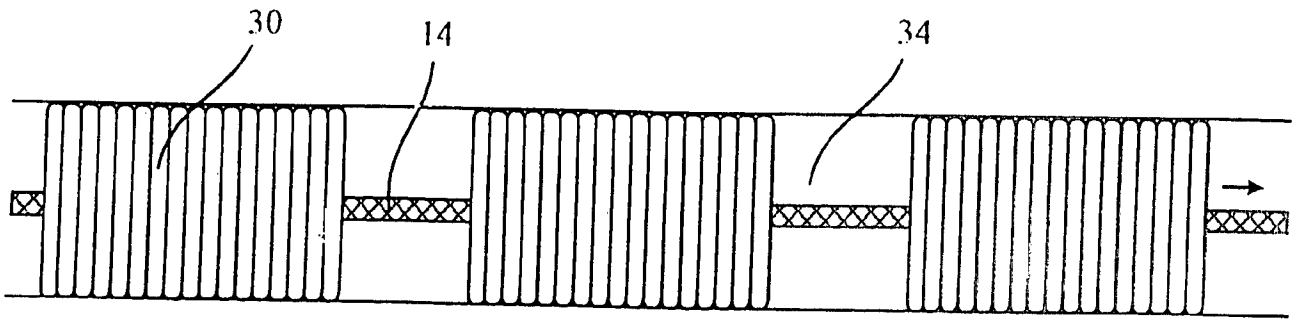
FIG. 18 shows the plan view of the tube section of FIG. 17.
Figure 23:
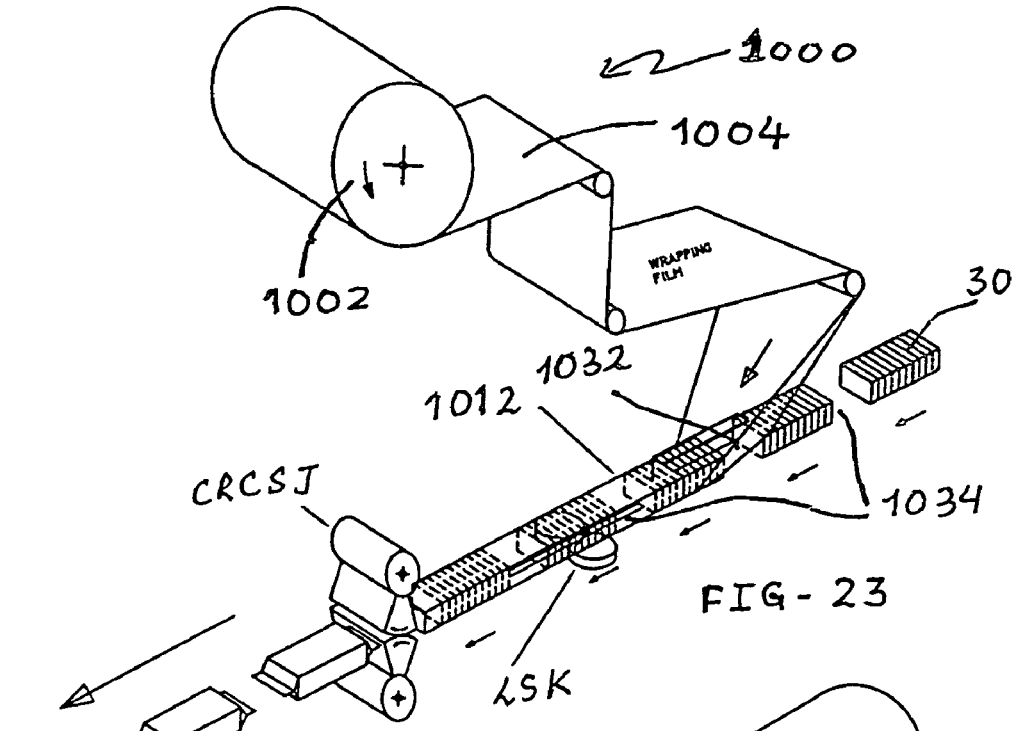
FIG. 23 is a scheme of a forming station for a method of making packages in the prior art.

Referring to FIGS. 6 and 7 of the drawings, the packages shown in FIGS. 6 and 7 are manufactured typically by a process seen in FIGS. 17 and 18 and FIG. 23 of the drawings.

What is shown in FIGS. 17 and 18 and FIG. 23 are the forming section of a wrapping machine which is well known in the packaging/material handling art. The packages in accordance with the prior art are formed in the forming section of horizontal or vertical wrapping machines as seen in FIG. 23 which are well known in the packaging/material handling art and typically comprise a forming section structure 1012 through which an elongated sheet of flexible wrapping material 1004 is drawn from a roll 1002. The forming section is operative to continuously form from the sheet a forwardly moving tube 32 having a rearwardly disposed open inlet end, and a laterally projecting "fin" defined by drawn-together side edge portions of the sheet. An article in-feed system [not shown] is used to insert articles to be wrapped into the open tube inlet end. The inserted articles, in a longitudinally spaced group 30, are then carried within the wrapping material linearly to as it forwardly exits the forming section. The individual articles, or associated groups of articles, as may be the case, forwardly transported within the tube are spaced apart by spaced longitudinal sections 1034 of the tube. and typically comprises a forming section structure through which an elongated sheet of flexible wrapping material is drawn from a roll. The forming section is operated to continuously form from the sheet a forwardly moving tube 12 having a rearwardly disposed open inlet end 32, and a laterally projecting "fin" seal 14 defined by drawn-together side edge portions of the sheet. The fin seal may be a fin seal or a simple overlap seal. Reference in this specification to a fin seal includes reference to an overlap seal. An article in-feed system is used to insert articles or groups or groups of articles 30 to be wrapped into the open tube inlet end 32. The inserted articles, in a longitudinally spaced group as seen in FIGS. 17 and 18, are then carried within the wrapping material tube 12 linearly to as it forwardly exits the forming section. The individual articles, or associated groups of articles, as may be the case, forwardly transported within the tube are spaced apart by spaced longitudinal sections 34 of the tube 12. In the subsequent sealing station [not shown], seals are applied in the intervening spaces 34 and a cut applied between the seals to form the package. As the article-containing tube exits the forming section, the fin portion of the tube is drawn between, and sealed by, an opposed pair of counter rotating sealing elements LSR. The sealed fin is then passed through a foldover station, which operates to fold the sealed fin over onto an adjacent portion of the tube. The tube, with its sealed and folded over fin, is then passed through a cutting and sealing station having cross seal jaws CRCSJ which operates to compress, heat seal, and transversely cut the longitudinal tube sections between longitudinally adjacent articles or groups of pre arranged article pairs, to form individual, article-containing packages with sealed opposite ends.

As seen in FIGS. 17 and 18 both ends of the article or group of articles 30 are unsupported. It is therefore possible for the leading article to fall within the intervening space 34 before entering the sealing station in which the end seals are applied.

Figure 19:
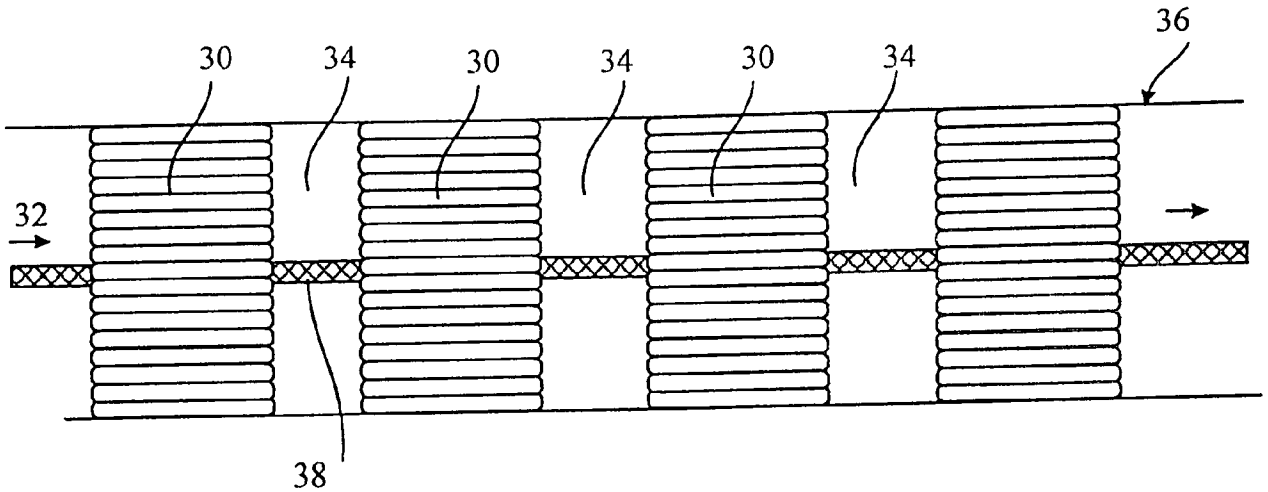
FIG. 19 shows the end elevation of the tube section during formation of the packages in accordance with this invention.
Figure 20:
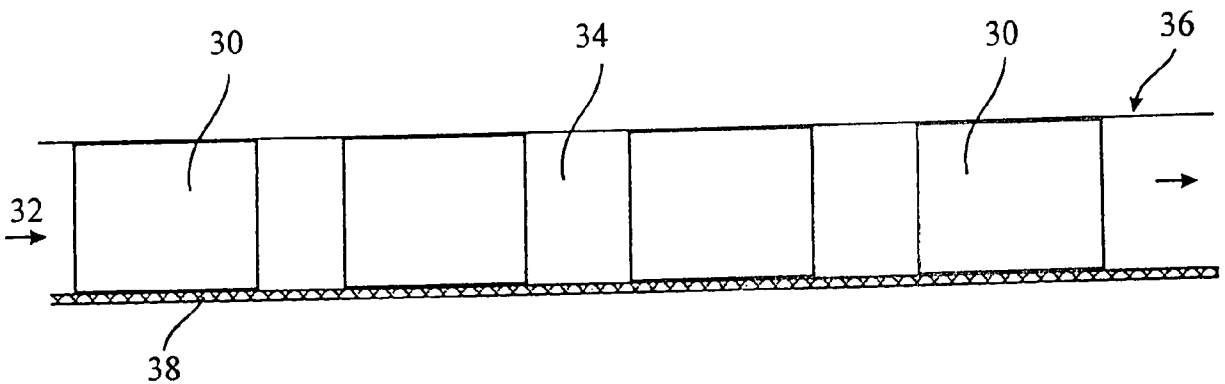
FIG. 20 shows the plan view of the tube section of FIG. 19.
Figure 24:
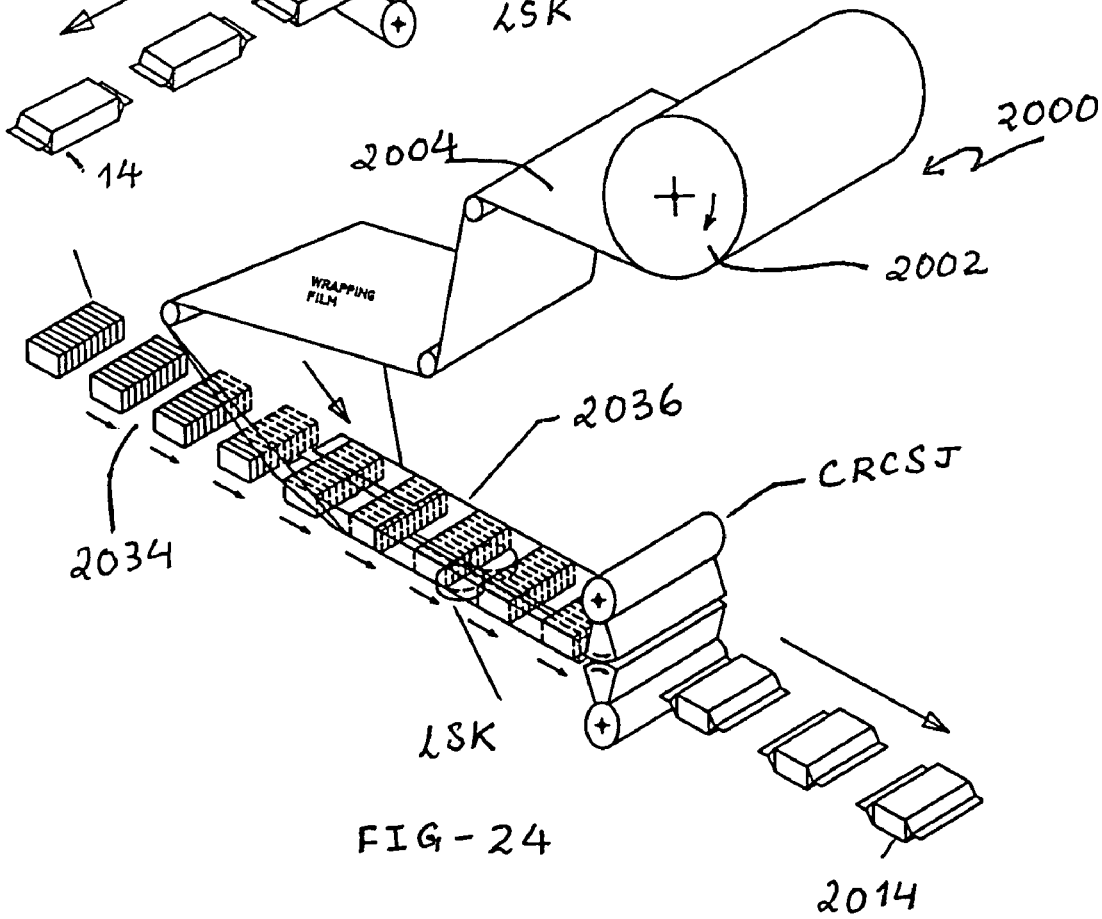
FIG. 24 is a scheme of a forming station for a method of making packages in accordance with this invention.

As seen in FIGS. 19 and 20 and FIG. 24 which shows a forming section structure generally indicated by the reference numeral 2000 through which an elongated sheet of flexible wrapping material 2004 is drawn from a roll 2002 to enter the forming station in the form of a tube 2036. The article or pre arranged group of articles 30 are fed within the tube 2036 sideways or laterally or width-wise instead of length wise and in the fin sealing station LSR the flexible wrapping sheet is wrapped around the length of the article or the group of articles 30 unlike in the conventional feeding system of FIG. 23 where the articles or pre arranged group of articles are fed along their length and the flexible wrapping sheets are wrapped around the width of the article or group of articles. The fin seal 38 as seen in figure as seen in FIG. 19 is formed across the articles or group of articles as seen in FIG. 20.

The speed of formation of the packages is therefore considerably increased as in the same length in the forming station many more article or article groups are wrapped in the in the same time. Trials have shown that using the package in accordance with this invention it is possible to produce at least 20 percent more and up to 100 percent more packages in a given unit of time.

It is not possible for an article to be displaced within the tube 36 during formation as the wrapped sheet element holds the article or group of articles at both ends and itself acts as a guide which align the articles, particularly articles like biscuits or cookies which are packed when on edge and therefore there is no wastage in the formation of the packages in accordance with this invention on account of the leading biscuit or other article falling as in the conventional package.

FIGS. 21*a* and 21*b* illustrate packages in the prior art which are not gusseted.

FIGS. 22*a* and 22*b* illustrate packages in accordance with this invention which are not gusseted.

It is thus believed that the operation and construction of the present invention will be apparent from the foregoing description of a preferred embodiment. While the device and methods shown are described as being preferred, it will be obvious to a person of ordinary skill in the art that various changes and modifications may be made therein without departing from the spirit and scope of the invention.

The invention claimed is:

1. An improved package for wrapping at least one article or a pre arranged group of articles, said package being defined by a formed longitudinal tube body of flexible wrapping sheet material having a length, height and width dimension, the said height and/or width dimension being less than the length dimension but greater than one tenth of the length dimension, a fin seal and two cross seals and no end seals, wherein the fin seal is formed along the height or width dimension of the package perpendicular to the length dimension and the cross seals are formed along the length dimension, the cross seals being generally perpendicular to the fin seal, with the ends of the package being seal-free.

2. An improved package for wrapping at least one article or a pre arranged group of articles, as claimed in claim 1, in which the longitudinal tube has a generally rectangular cross section.

3. An improved package for wrapping at least one article or a pre arranged group of articles, as claimed in claim 1, in which the longitudinal tube has a generally circular cross section.

4. An improved package for wrapping at least one article or a pre arranged group of articles, as claimed in claim 1, in which the longitudinal tube has a generally oval cross section.

5. An improved package for wrapping at least one article or a pre arranged group of articles, as claimed in claim 1, in which a string of packages are formed and the packages are joined together at the cross seals.

6. An improved package for wrapping at least one article or a pre arranged group of articles, as claimed in claim 1, in which the cross seals are flattened against the body of the package.

7. An improved package for wrapping at least one article or a pre arranged group of articles, as claimed in claim 1, in which the article or group of articles are supported in the package in a tray.

* * * * *